US007948730B2

(12) United States Patent
Oliveira et al.

(10) Patent No.: US 7,948,730 B2
(45) Date of Patent: May 24, 2011

(54) FAST TURN-OFF AND FAST TURN-ON OF AN INDUCTIVE LOAD AND USAGE IN VEHICLE APPLICATION

(75) Inventors: Gary Oliveira, Lake Orion, MI (US); Todd Ferguson, Fenton, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 53 days.

(21) Appl. No.: 11/991,042

(22) PCT Filed: Aug. 25, 2006

(86) PCT No.: PCT/US2006/033272

§ 371 (c)(1),
(2), (4) Date: Jun. 15, 2009

(87) PCT Pub. No.: WO2007/025162

PCT Pub. Date: Mar. 1, 2007

(65) Prior Publication Data

US 2009/0250302 A1 Oct. 8, 2009

Related U.S. Application Data

(60) Provisional application No. 60/711,780, filed on Aug. 26, 2005.

(51) Int. Cl.
*H01H 47/00* (2006.01)
*H01H 9/00* (2006.01)

(52) U.S. Cl. ..... 361/154; 361/156; 361/139; 307/125

(58) Field of Classification Search ..... 361/139, 361/91.1, 91.5, 154, 156, 189, 190, 238, 361/242; 307/125
See application file for complete search history.

(56) References Cited

U.S. PATENT DOCUMENTS

| | | | | |
|---|---|---|---|---|
| 4,361,129 | A * | 11/1982 | Sugie et al. | 123/622 |
| 5,631,829 | A | 5/1997 | Takasaki et al. | |
| 6,157,095 | A | 12/2000 | Namuduri | |
| 6,165,098 | A | 12/2000 | Hebbale et al. | |
| 6,545,852 | B1 | 4/2003 | Arnold | |
| 6,631,779 | B2 * | 10/2003 | Watson et al. | 180/248 |
| 6,725,992 | B1 | 4/2004 | Ray et al. | |
| 2001/0048086 | A1 * | 12/2001 | Parsons et al. | 251/129.04 |
| 2004/0044459 | A1 | 3/2004 | Wakao et al. | |
| 2005/0047053 | A1 * | 3/2005 | Meyer et al. | 361/139 |
| 2005/0133285 | A1 | 6/2005 | Shimizu | |

FOREIGN PATENT DOCUMENTS

| | | | |
|---|---|---|---|
| GB | 2 368 210 | | 4/2002 |
| GB | 2368210 | * | 4/2002 |

* cited by examiner

*Primary Examiner* — Patrick Salce
(74) *Attorney, Agent, or Firm* — Warn Partners, P.C.

(57) ABSTRACT

A fast turn-off and fast turn-on circuit (10) providing at least one power source (12, 20), at least one switching device (14, 22), a coil (16), and at least a first voltage control device (18). The at least one switching device (14, 22) is connected to the at least one power source (12, 20) for selectively connecting the at least one power source (12, 20) to portions of the circuit (10). An electrical current from at least one power source (12, 20) charges the coil (16) and creates an electromagnetic field when the at least one switching device (14, 22) is in a closed position and connects the at least one power source (12, 20) with the coil (16). The first voltage control device (18) limits a voltage in the circuit (10) when the electromagnetic field decays.

27 Claims, 3 Drawing Sheets

FAST TURN-OFF AND FAST TURN-ON OF AN INDUCTIVE LOAD AND USAGE IN VEHICLE APPLICATION

CROSS-REFERENCE TO RELATED APPLICATIONS

This application is a National Stage of International Application No. PCT/US2006/033272, filed Aug. 25, 2006. This application claims priority to United States Patent Application No. 60/711,780 filed on Aug. 26, 2005. The disclosures of the above applications are incorporated herein by reference.

FIELD OF THE INVENTION

The present invention relates to a vehicle circuit design and method for providing a fast turn-off and fast turn-on of an inductive load.

BACKGROUND OF THE INVENTION

In all wheel drive (AWD) and four wheel drive systems in motorized vehicles, the front and rear axles can be coupled via an electromagnetic clutch which enable all of the vehicle's wheels to rotate in relation to one another. These vehicles can also be equipped with driver assistance systems, such as, stability control, traction control, and anti-lock brake systems (ABS). When a stability event occurs, and the vehicle's stability control, traction control, and/or ABS system is in use, the wheels can be decoupled from each other so that they can rotate and react independent of each other. The effectiveness of the driver assistance systems depends on the time it takes to decouple the vehicle's wheels; front-to-rear and side-to-side. If the vehicle's wheels are not decoupled quickly then activation of the vehicle's driver assistance systems will be delayed.

The response time of the stability control system is dependent on the time it takes to decay the current in a circuit which creates the electromagnetic field. In addition, the torque in an electromagnetic clutch system is dependent on the amount of current flowing through a coil which is used to create the electromagnetic field. The rate at which the electromagnetic field is created is directly proportional to the rate at which the current builds in the system. Likewise, the rate at which the magnetic field collapses in a system is proportional to the rate at which the current decays in the coil. Thus, the rate at which the current decays in a coil is proportional to the resistance in the circuit. The lower the resistance in the circuit the faster the circuit decays, causing the torque of the electromagnetic clutch to decay at a rate that is proportional to the current decay of the clutch coil.

Therefore, it is desirable to develop a circuit design where the current in a coil dissipates quickly in order to quickly decay an electromagnetic field, and the current passing through the coil creates an electromagnetic field quickly.

SUMMARY OF THE INVENTION

The present invention relates to a fast turn-off and fast turn-on circuit providing at least one power source, at least one switching device, a coil, and at least a first voltage control device. The at least one switching device is connected to the at least one power source for selectively connecting the at least one power source to portions of the circuit. An electrical current from the at least one power source charges the coil and creates an electromagnetic field when the at least one switching device is in a closed position and connects the at least one power source with the coil. The first voltage control device is connected to the coil, and the first voltage control device limits a voltage in the circuit when the electromagnetic field decays.

Another embodiment of the present invention relates to a method for a fast turn-off and fast turn-on circuit having the steps of first providing a controller interfaced with a plurality of switching devices, where the plurality of switching devices are used for selectively connecting at least one power source with other portions of the circuit. Providing a coil connected to the plurality of switching devices, where the coil produces an electromagnetic field when at least one of the pluralities of switching devices is closed and the coil is connected at least one power source, such that an electrical current passes through the coil. Determining if the electromagnetic field needs to be decayed. Commanding at least one of the plurality of switching devices to open by a controller if it is determined that the electromagnetic field needs to be decayed. Opening at least one of the plurality of switching devices in order for the electrical current to dissipate from the coil and decay the electromagnetic field. Providing at least a first voltage control device connected to the coil, where the first voltage control device is connected to the coil and limits a voltage in the circuit when the electromagnetic field is decaying.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
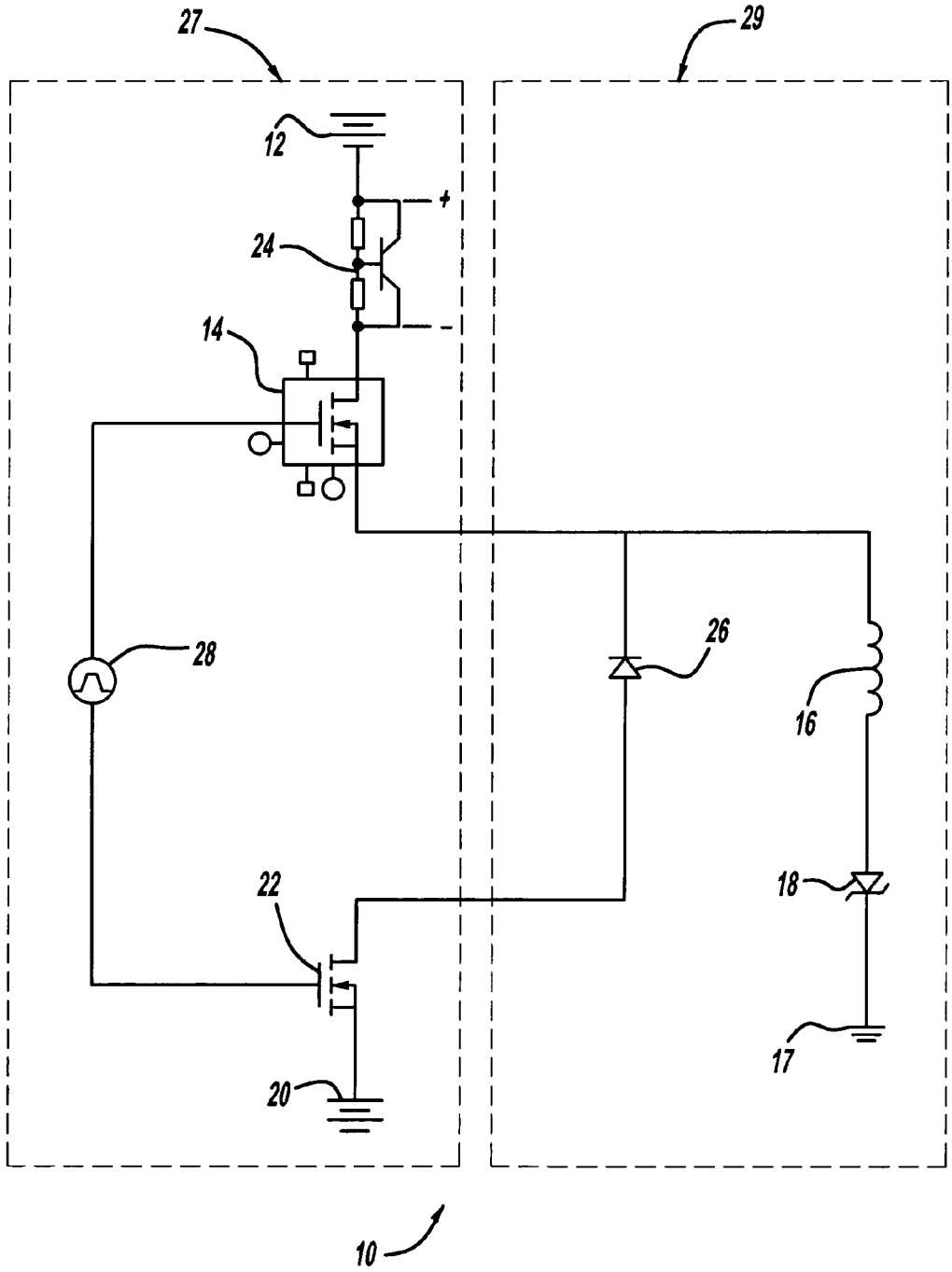
FIG. 1 is a schematic drawing of a fast-open and fast-close circuit in accordance with an embodiment of the present invention.

Referring to FIG. 1, a fast turn-off and fast turn-on circuit is generally shown at 10. The circuit 10 has at least a first power source 12, and at least a first switching device 14 that is used to selectively connect the power source 12 to other portions of the circuit 10. A coil 16 is connected between a ground connection 17 and the first power source 12 when the first switching device 14 is in a closed position, which causes an electrical current to pass through the coil 16 and create an electromagnetic field. A first voltage control device 18 is connected to the coil 16, which limits a voltage of a circuit 10 when the electromagnetic field is decayed, which is described in greater detail below.

In an embodiment, the first power source 12 can be in series with the coil 16, and a second power source 20 can be in parallel with the coil 16. Typically, both power sources 12, 20 are the same type of power source which have the same voltage, but it is within the scope of the present invention that power source 12 can have a different voltage than power source 20.

Typically, the first switching device 14 is connected to the power source 12, and a second switching device 22 is connected to the second power source 20. Thus, when the switching devices 14, 22 are closed, the power sources 12, 20, respectively, are connected to the coil 16 so that an electrical current can pass through the coil 16. The switching devices 14, 22 can be the same type of switching device, such as but not limited to, a MOSFET transistor or the like. When the switching devices 14, 22 are the same type of device they are capable of opening and closing substantially simultaneously, if desired. However, it should be appreciated that the switching devices 14, 22 can be different types of devices, so long as the switching devices 14, 22 can open and close at substantially the same rate.

In one embodiment, the first voltage control device 18 is a voltage clamping device. By way of explanation and not limitation, the first voltage control device 18 can be a zener diode or the like. Thus, the zener diode or first voltage control device 18 can be tuned to a predetermined voltage in order to control the voltage or a voltage spike in the circuit, such that the first voltage control device 18 will clamp the voltage in the circuit 10 so that the voltage does not exceed a predetermined voltage limit.

In an alternate embodiment, a second voltage control device 24 (shown in phantom) can be connected between the first power supply 12 and the first switching device 14. The second voltage control device 24 can be used for increasing the voltage in the circuit 10, which results in a larger electrical current in the circuit 10, when creating the electromagnetic field by passing current through the coil 16. The second voltage control device 24 can be by way of example but not limitation, a voltage multiplier or the like, where the voltage from the first power supply 12 is multiplied by the second voltage control device 24 in order to create a larger current in the circuit 10. The second voltage control device 24 allows the circuit 10 to be a fast turn-on circuit in order to quickly create the electromagnetic field as current passes through the coil 16 due to the larger current in the circuit 10 as a result of the voltage from the first power supply 12 being multiplied The circuit 10 can also have a third voltage control device 26 that is in parallel with the coil 16. Typically, the third voltage control device 26 creates a loop with the coil 16 when at least the second power source 20 is connected to the coil 16. Thus, an electrical current is continuously passing through the coil 16 due to the third voltage control device 26 being in parallel with the coil 16 which creates the electromagnetic field. An example of the third voltage control device 26 is, but not limited to, a flyback diode or the like. The third voltage control device 26 can also clamp the voltage of the circuit 10 at a predetermined voltage such that the voltage in the circuit 10 does not exceed a predetermined voltage limit.

A controller 28 can be connected to either or both the first switching device 14 and second switching device 22. The controller 28 is used to command actuation of switching devices 14, 22 in order to open and close the circuit 10, which either allows current to pass through the coil 16 or prevent an electrical current from passing through the coil 16. The controller 28 can be, but is not limited to, an engine control unit, a controller that is interfaced with the engine control unit, or the like. Thus, as described below, the controller commands at least one of the switching devices 14, 22 to open or close based upon operating conditions of a motorized vehicle (not shown).

In an embodiment, predetermined components of the circuit 10 can be included in an interactive torque management control unit generally indicated at 27 (shown in phantom). The interactive torque management control unit 27 can include, by way of example but not limitation, the power sources 12, 20, the switching devices 14, 22, the second voltage control device 24, the control unit 28, or a combination thereof. Additionally, predetermined components of the circuit 10 can be included in an interactive torque management clutch unit generally indicated at 29. The interactive torque management clutch unit 29 can include, by way of example but not limitation, the coil 16, the ground connection 17, the first voltage control device 18, the third voltage control device 26, or a combination thereof. Thus, the interactive torque management control unit 27 and the interactive torque management clutch unit 29 can be interfaced with one another.

Figure 2:
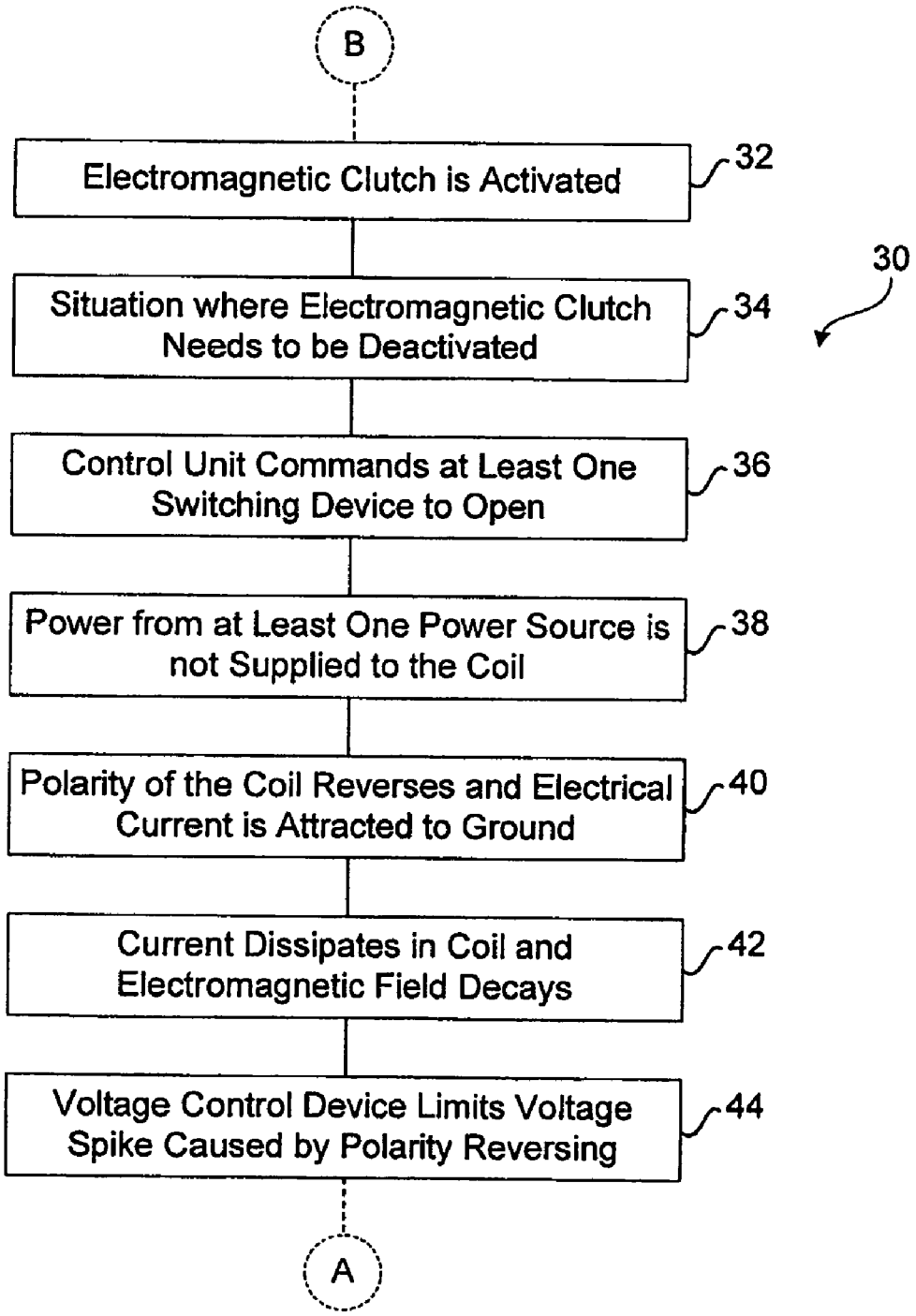
FIG. 2 is a flow chart of a method for a fast turn-off of a circuit in accordance with an embodiment of the present invention.

In reference to FIGS. 1 and 2, a method for fast turn-off of the circuit 10 is generally shown at 30. By way of explanation and not limitation, the method 30 is shown describing the use of the circuit 10 where the coil 16 is part of an electromagnetic clutch in the motorized vehicle. When current passes through the coil 16 to create the electromagnetic field, an armature (not shown) is pulled closer to a rotor (not shown) in order for the armature to rotate with respect to the rotor and couple either the front and rear wheels (not shown), the first side wheels, or the rear side wheels of the motorized vehicle.

At decision box 32, the electromagnetic clutch is activated, such that an electrical current is passing from the power supplies 12, 22 through the coil 16. At decision box 34, a situation arises where the electromagnetic clutch needs to be deactivated. An example of the situation where it is desirable to deactivate the electromagnetic clutch is, but not limited to, when a driver assistance system is activated and the motorized vehicle's stability control system, traction control system and/or the vehicle's anti-lock brake system is in use. At this time it is desirable for the wheels of the motorized vehicle to decouple and rotate independently of each other, such that the armature and rotor are no longer rotating with respect to one another.

When the situation arises where the electromagnetic clutch needs to be deactivated, as in decision box 34, the control unit 24 commands at least one of the switching devices 14, 22 to open, at decision box 36. At decision box 38, when at least one of the switching devices 14, 22 are opened, the electrical current no longer passes from the power supply 12, 22 depending upon which switching device 14, 22 was open, to the coil 16.

At decision box 40, when an electrical current no longer passes from one of the power supplies 12, 22 to the coil 16, the polarity of the coil 16 reverses so that the electrical current is attracted to a ground connection 17. When the polarity of the coil 16 changes, the current flowing through the coil 16 begins to flow in the opposite direction so the current no longer passes continuously through the loop with the third voltage control device 28 and is instead attracted and flows to the ground connection 17. At decision box 42, the current dissipates in the coil 16 and the electromagnetic field decays, since there is no longer an electrical current passing from the power supplies 12, 22 to the coil 16. At decision box 44, the first voltage control device 18 limits a voltage spike in the circuit 10 which is caused by the polarity of the coil 16 reversing. Thus, the first voltage control device 18 clamps the voltage of the circuit 10 at a predetermined voltage limit. If the voltage spike and/or the current in the circuit 10 are not controlled it could cause severe damage to the circuit 10 and other components in the motorized vehicle due to the other components not being able to withstand a high voltage and/or high current.

Figure 3:
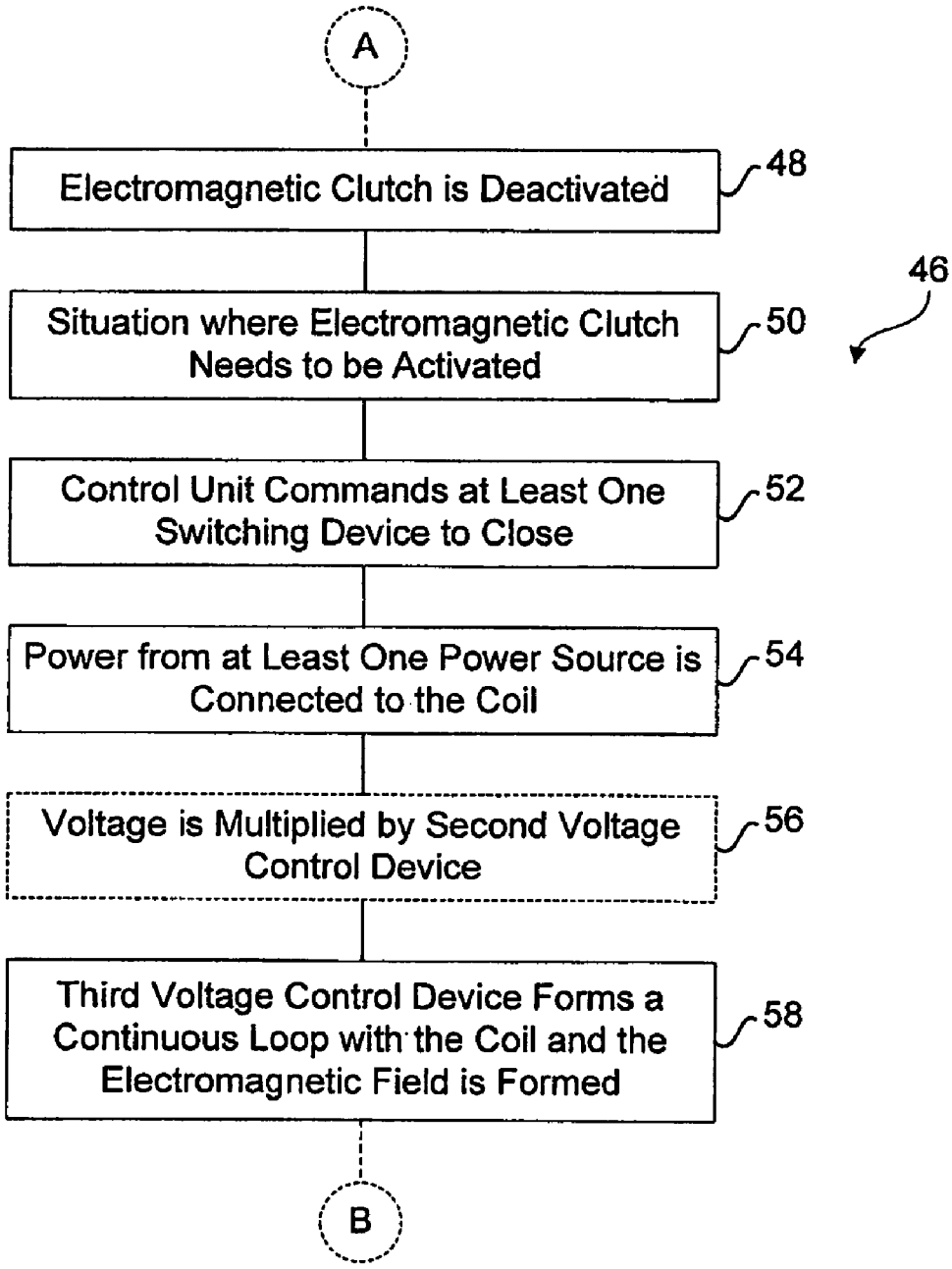
FIG. 3 is a flow chart of a method for a fast turn-on of a circuit in accordance with an embodiment of the present invention.

In reference to FIGS. 1 and 3, method for a fast turn-on of the circuit 10 is generally shown at 46. At decision box 48, the electromagnetic clutch is deactivated. At decision box 50, a situation arises where it is desirable to activate the electromagnetic clutch. An example of a situation where it is desirable to have the electromagnetic clutch activated is when the motorized vehicle's stability control system or traction control system is in use and it is desirable for some or all the wheels on the vehicle to be coupled and rotate with respect to each other, such that the electromagnetic field cause the armature and rotor to rotate with respect to one another.

At decision box 52, when the situation arises for the electromagnetic clutch to be activated, the control unit 28 commands at least one of the switching devices 14, 22 to close. At decision box 54, an electrical current passes from at least one power source 12, 20 to the coil 16 in order for the electrical current to pass through the coil 16 and create an electromagnetic field. At decision box 56, when the second voltage control device 24 is used, the voltage from the first power supply 12 is multiplied in order to increase the voltage in the circuit 10 which results in an increase of current flowing through the circuit 10 and passing through the coil 16 that creates a stronger electromagnetic field and/or the larger current more quickly creates the electromagnetic field when compared to a circuit that does not include the second voltage control device 24.

At decision box 58, the third voltage control device 26 forms a continuous loop with the coil 16 in order to continuously pass the electrical current through the coil 16 to form the electromagnetic field. The third voltage control device 26 is used when the control unit 28 commands the second switching device 22 to close, which connects the second power source 20 with the coil 16.

With respect to FIGS. 2 and 3, the methods of controlling the circuit can be combined as shown by the phantom boxes A and B. Thus, the methods 30, 46 can be combined to form a continuous method where the electromagnetic is activated or deactivated depending upon the situations.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fast turn-off and fast turn-on circuit for an interactive torque management clutch and control arrangement comprising:

a first power source;

at least one first switching device connected to said first power source for selectively connecting said first power source to portions of said circuit;

a coil, wherein an electrical current from said at least one power source charges said coil and creates an electromagnetic field when said at least one switch is in a closed position and connects said at least one power source and said coil;

a first voltage control device connected to said coil, wherein said first voltage control device limits a voltage in said circuit when said electromagnetic field decays;

a second power source connected in parallel with said coil;

a second switching device connected to said second power source for selectively connecting said second power source to portions of said circuit;

an interactive torque management control unit containing said first power source, said at least one switching device, said second power source, and said at least one second switching device; and an interactive torque management clutch arrangement containing said coil and said first voltage control device.

2. The fast turn-off and fast turn-on circuit of claim 1 further comprising a second voltage control device that increases said voltage when said at least one switching device is closed.

3. The fast turn-off and fast turn-on circuit of claim 2, wherein said second voltage control device is a voltage multiplier.

4. The fast turn-off and fast turn-on circuit of claim 1, wherein said first voltage control device is a zener diode.

5. The fast turn-off and fast turn-on circuit of claim 1, wherein said first voltage control device is integrated in a controller.

6. The fast turn-off and fast turn-on circuit of claim 1, wherein said first power source in series with said coil.

7. The fast turn-off and fast turn-on circuit of claim 1 further comprising a third voltage control device connected to said second power source and in parallel with said coil.

8. The fast turn-off and fast turn-on circuit of claim 1, wherein said at least one first switching device is a MOSFET transistor.

9. The fast turn-off and fast turn-on circuit of claim 1, wherein said circuit is used in at least one selected from the group of a transfer case, independent torque modulation coupling, axle systems having a locking device, air conditioning compressors, and electromagnetic clutch fans.

10. A method for a fast turn-off and fast turn-on circuit for an interactive torque management clutch and control arrangement comprising the steps of:

providing an interactive torque management control unit having a first power source with at least one first switching device connected to said first power source for selectively connecting said first power source to portions of said circuit, a second power source with at least one second switching device connected to said second power source for selectively connecting said second power source to portions of said circuit, a controller interfaced with said at least one first switching device and said at least one second switching device for selectively connectinq said first power source and said second power source with portions of said circuit;

an interactive torque management clutch unit having a coil connected to said first switching device and said second switching device, wherein said coil produces an electromaqnetic field when either one of said first switchinq device or said second switching device is closed and said coil is connected to said power source and an electrical current passes through said coil, at least a first voltage control device connected to said coil;

providing a first voltage control device connected to said coil;

determining if said electromagnetic field needs to be decayed;

commanding at least one of said at least one first switching device and said second switching device to open by a controller if it is determined that said electromagnetic field needs to be decayed;

opening said at least one first switching device and said second switching device in order for said electrical current to dissipate from said coil and decay said electromagnetic field; and operating said at least a first voltage control device connected to said coil, wherein said first voltage control device is connected to said coil and limits a voltage in said circuit when said electromagnetic field is decaying.

11. The method for a fast turn-off and fast turn-on circuit of claim 10 further comprising the step of a polarity of said coil reversing when said controller commands at least one of said first switching device and second switching device to open.

12. The method for a fast turn-off and fast turn-on circuit of claim 11, wherein said first voltage control device limits said voltage in said circuit when said polarity of said coil reverses.

13. The method for a fast turn-off and fast turn-on circuit of claim 10 further comprising the step of providing a second voltage control device connected to said first power source, wherein said second voltage control device is a voltage multiplier.

14. The method for a fast turn-off and fast turn-on circuit of claim 10 further comprising the step of providing a third voltage control device connected to said first power source and said second power source, said third voltage control device is in parallel with said coil for creating a loop with said coil in which said electrical current continuously passes through when creating said electromagnetic field.

15. The method for a fast turn-off and fast turn-on circuit of claim 14, wherein said third voltage control device is a fly-back diode.

16. The method for a fast turn-off and fast turn-on circuit of claim 10, wherein said at least one first switching device is a MOSFET transistor.

17. The method for a fast turn-off and fast turn-on circuit of claim 10, wherein said circuit is used in at least one selected from the group of a transfer case, independent torque modulation coupling, axle systems having a locking device, air conditioning compressors, and electromagnetic clutch fans.

18. A method for a fast turn-off and fast turn-on circuit for an interactive torque management clutch and control arrangement comprising the steps of:

providing an interactive torque management control unit having a first power source with at least one first switching device connected to said first power source for selectively connecting said first power source to portions of said circuit, a second power source with at least one second switching device connected to said second power source for selectively connecting said second power source to portions of said circuit, a controller interfaced with said at least one first switching device and said at least one second switching device for selectively connecting said first power source and said second power source with portions of said circuit;

an interactive torque management clutch unit having a coil connected to said first switching device and said second switching device, wherein said coil produces an electromaqnetic field when either one of said first switching device or said second switching device is closed and said coil is connected to said power source and an electrical current passes through said coil, at least a first voltage control device connected to said coil;

providing at least a voltage control device connected to said at least one power source, wherein said voltage control device increases the voltage from said at least one power source;

determining if said electromagnetic field needs to be created;

commanding at least one first switching device and said second switching device to close by a controller if it is determined that said electromagnetic field needs to be created; and increasing said voltage in said circuit by said voltage control device in order to increase said electrical current passing through said coil.

19. The method for a fast turn-off and fast turn-on circuit of claim 18 further comprising the step of providing a voltage control device connected to said coil, wherein said voltage control device limits said voltage in said circuit when said controller commands at least one of said switching devices to open.

20. The method for a fast turn-off and fast turn-on circuit of claim 19 further comprising the step of a polarity of said coil reversing when said controller commands at least one of said plurality of switching devices to open.

21. The method for a fast turn-off and fast turn-on circuit of claim 18 further comprising the step of providing a voltage control device connected to said power source and in parallel with said coil for creating a loop with said coil in which said electrical current continuously passes through when creating said electromagnetic field.

22. The method for a fast turn-off and fast turn-on circuit of claim 18, wherein said first switching device is a MOSFET transistor.

23. The method for a fast turn-off and fast turn-on circuit of claim 18, wherein said circuit is used in at least one selected from the group of a transfer case, independent torque modulation coupling, axle systems having a locking device, air conditioning compressors, and electromagnetic clutch fans.

24. A method for a fast turn-off and fast turn-on circuit comprising the steps of:

providing an interactive torque management control unit having a controller, a first power source and a second power source, a plurality of switches interfaced with said controller and said first power source and said second power source for selectively connecting said first power source and said second power source with portions of said circuit and a second voltage control device connected to said first power source;

an interactive torque management clutch unit having a coil connected to said plurality of switching devices wherein said coil produces an electro-magnetic field when said at least one of said plurality of switching devices is closed and said coil is connected to said first power source and said second power source and electrical current passes through said coil, and a first voltage control device connected to said coil;

determining if said electromagnetic field needs to be decayed;

commanding at least one of said plurality of switching devices to open by a controller if it is determined that said electromagnetic field needs to be decayed;

opening at least one of said plurality of switching devices in order for said electrical current to dissipate from said coil and decay said electromagnetic field;

reversing the polarity of said coil when at least one of said plurality of switching devices is opened;

limiting a voltage in said circuit by said first voltage control device when said polarity of said coil reverses and said electromagnetic field decays;

determining if said electromagnetic field should be created;

multiplying said voltage in said circuit by said second voltage control device when said controller commands said plurality of switching devices to close which connects said at least one power source, said second voltage control device, and said coil.

25. The method for a fast turn-off and fast turn-on circuit of claim 24 further comprising the step of providing a third voltage control device connected to said power source and in parallel with said coil for creating a loop with said coil in which said electrical current continuously passes through when creating said electromagnetic field.

26. The method for a fast turn-off and fast turn-on circuit of claim 24, wherein at least one of said plurality of switching devices is a MOSFET transistor.

27. The method for a fast turn-off and fast turn-on circuit of claim 24, wherein said circuit is used in at least one selected from the group of a transfer case, independent torque modulation coupling, axle systems having a locking device, air conditioning compressors, and electromagnetic clutch fans.

* * * * *

UNITED STATES PATENT AND TRADEMARK OFFICE

CERTIFICATE OF CORRECTION

PATENT NO. : 7,948,730 B2
APPLICATION NO. : 11/991042
DATED : May 24, 2011
INVENTOR(S) : Gary Oliveira et al.

It is certified that error appears in the above-identified patent and that said Letters Patent is hereby corrected as shown below:

Column 6,
Line 46, “connectinq” should be --connecting--.

Column 6,
Line 51, “maqnetic” should be --magnetic--.

Column 6,
Line 51, “switchinq” should be --switching--.

Signed and Sealed this
Twentieth Day of December, 2011

David J. Kappos

David J. Kappos
*Director of the United States Patent and Trademark Office*